United States Patent [19]

Ijff et al.

[11] 4,358,636

[45] Nov. 9, 1982

[54] MULTIPLE COAXIAL CABLE

[75] Inventors: Barend Ijff, Eindhoven; Jozef P. van de Hoef, Hilversum, both of Netherlands

[73] Assignee: U.S. Philips Corporation, New York, N.Y.

[21] Appl. No.: 161,959

[22] Filed: Jun. 23, 1980

[30] Foreign Application Priority Data

Jul. 6, 1979 [NL] Netherlands ..... 7905279

[51] Int. Cl.[3] ..... H01B 7/18

[52] U.S. Cl. ..... 174/103; 174/34; 174/113 R; 174/115

[58] Field of Search ..... 174/103, 106 R, 27, 174/127, 34, 113 R, 115, 36, 102, 128 R

[56] References Cited

U.S. PATENT DOCUMENTS

| | | | |
|---|---|---|---|
| 290,853 | 12/1883 | Campbell | 174/103 X |
| 2,036,045 | 3/1936 | Harris | 174/34 |
| 2,118,629 | 5/1938 | Waldron | 174/103 |
| 2,167,098 | 7/1939 | Wells | 174/103 |
| 2,216,340 | 10/1940 | Elliott | 174/103 |
| 3,099,703 | 7/1963 | Martin | 174/34 |
| 3,211,821 | 10/1965 | Wakefield | 174/26 |
| 3,482,034 | 12/1969 | Rhoades et al. | 174/102 R |
| 3,560,631 | 2/1971 | Rhoades et al. | 174/113 R |
| 3,651,243 | 3/1972 | Hornor et al. | 174/103 X |
| 3,772,454 | 11/1973 | Donecker et al. | 174/103 X |

FOREIGN PATENT DOCUMENTS

| | | | |
|---|---|---|---|
| 2240403 | 2/1974 | Fed. Rep. of Germany . | |
| 891919 | 3/1962 | United Kingdom | 174/27 |

*Primary Examiner*—Volodymyr Y. Mayewsky
*Attorney, Agent, or Firm*—David R. Treacy

[57] ABSTRACT

An electrical connecting cable having a central coaxial unit around whose outer conductor a layer of conducting wire is placed. Several coaxial units identical to the central unit are wound around the layer of wires, the whole being surrounded by a sheath having an outer cover of an insulating material. Preferably, seven units are wound around the central unit.

5 Claims, 1 Drawing Figure

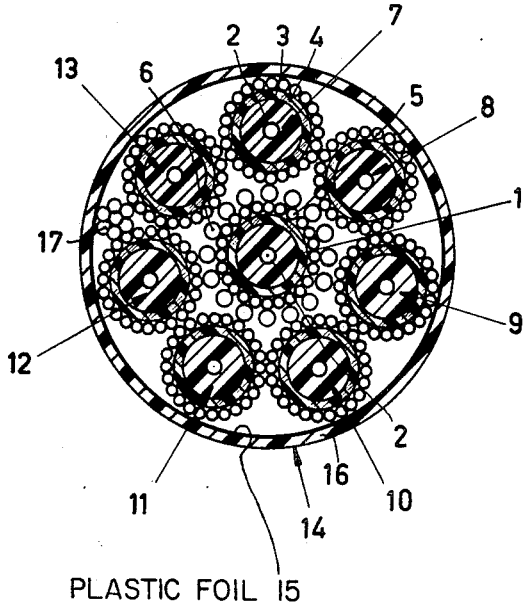
7
2
3
4
13
6
5
8
1
17
9
12
2
16
10
11
14
PLASTIC FOIL 15

MULTIPLE COAXIAL CABLE

BACKGROUND OF THE INVENTION

The invention relates to an electrical connecting cable especially useful for digital systems, comprising a central coaxial unit, around which several coaxial units are wound, each coaxial unit having a central conductor, a dielectric placed around the central conductor and an outer conductor laid around the dielectric; and a sheath serving as an outer cover, made of insulating material.

Connecting cables of this type are intended for connecting electrical circuits in digital systems, in which signals are transmitted from one circuit to the other via the connecting cable.

Examples of digital systems are, for example, computer installations, but especially also telephone exchanges.

The distance to be bridged by a connecting cable varies on the whole from 1 meter to several tens of meters. The total length of cable required for instance in a modern telephone exchange controlled by computers lies in the order of several kilometers. In such cases, the various connecting cables form intricate, bulky cable harnesses which run in cable channels between and along the large number of racks in which the electrical components to be connected, such as printed circuit panels, are accommodated.

It is known to connect the various components by means of single coaxial cables each comprising a central conductor, a dielectric, an outer conductor and an insulating sheath. In this, the central or signal conductor of the coaxial cable is connected with a contact point of a plug which, in its turn, is electrically connnected to, for instance, a panel. The outer conductor or ground conductor of the coaxial cable is connected to an adjacent contact point, also called the ground contact, of the plug. If several signals must be transmitted, then a corresponding number of single coaxial cables is necessary, all being connected to the adjacent contact points of the same plug in the above mentioned way.

The use of separate coaxial cables has various disadvantages. In the first place, the insulating sheath and the dielectric of each coaxial cable must be partly removed, in order to connect the central conductors and the outer conductors to the respective contact points of the connecting plug. Particularly, the connection of the outer conductors to the ground contacts of the plug is laborious, since each outer conductor must be provided with an additional ground connection such as a metal wire soldered to the outer conductor, which is subsequently connected to the contact point of the plug. As a result of self-induction of these ground connections the signalling behavior of the connecting cable is not optimal.

Another serious disadvantage is the unfavorable spatial arrangement of the separate coaxial cables. Often the cables are bundled by means of clamping rings into relatively bulky bundles which lead to practical problems when they are led through the racks of circuit panels.

There are moreover commercially available connecting cables in which several uninsulated coaxial wires are wound around a central coaxial wire and are surrounded by a common insulating sheath. This spatial arrangement is improved in comparison with the aforementioned system of separate coaxial cables. However, the flexibility and also the signalling behavior clearly leaves much to be desired. The outer conductors of the known connecting cable are formed by metal foil or metalized plastic foil, such as a polyester foil which is provided with a layer of aluminum.

It has become apparent that the electrical contact between the outer conductors is not optimal. Thus a resistance of approximately five ohms may occur between the foils. Moreover, the self-induction of the foils is too high, which causes a considerably increased attenuation when high-frequency signals are transmitted. It also has to be borne in mind that only six identical coaxial units, that is, units with the same dimensions and impedance, can be wound around a circular central coaxial unit in one layer, so that the single-layer cable contains a total of seven coaxial units. Many installations and exchanges are controlled by means of binary systems in which the number of connecting lines are powers of two, e.g. 4, 8, 16 etc. In this respect, a connecting cable with seven coaxial units is impractical.

SUMMARY OF THE INVENTION

The aim of this invention is to produce an electrical connecting cable which does not have the aforementioned disadvantages.

More particularly, the invention aims to produce a connecting cable which is less bulky in relation to the number of coaxial units and moreover exhibits good flexibility, so that the cable can easily be drawn through racks.

Another aim is to produce a cable from coaxial units in such a way that the outer conductors have good electrical contact with each other and consequently optimum signal transmission is realized.

Yet another aim is to produce a cable which can be connected to a connecting plug in a simple manner and in which it is not necessary to mount (solder) separate ground connections on the outer conductors of the coaxial units.

These aims are achieved in accordance with the invention in a multiple coaxial cable, which is characterized by the fact that a twisted layer of wires of electrically conducting material is placed around the outer conductor of the central coaxial unit.

The twisted wires of conducting materials are preferably made from metal, such as copper or tinned or silvered copper. The twisted circle of wires produces good electrical contact between the outer conductors of the coaxial units and has a very beneficial effect on the flexibility of the connecting cable. By grounding just one of the twisted wires, the entire layer and at the same time all the outer conductors are grounded. The self-induction of the ground connection in this construction of the cable can be reduced still further by grounding several of the twisted wires.

The central conductor of each coaxial unit is likewise made of metal, such as copper or tinned or silvered copper. It is preferably to choose the type of material for the twisted layer of wires and also that of the central conductor so that the twisted wires can be visually differentiated from the central conductors. Thus, for instance, one can choose a copper wire for the central conductor and make the twisted wires from tinned or silvered copper, or vice versa of course. It is understood that the twisted layer and the central conductors can also be distinguished on the basis of differences in thickness.

The dielectric of each coaxial unit is of the usual type and can for instance consist of a layer of plastic material, such as polyethylene, extruded around the central conductor, or can be composed of several layers, such as an inner layer of polyethylene and an outer layer of polytetrafluoroethylene.

The outer conductor is likewise of a usual type, such as a longitudinally or transversely wound metal foil or metalized plastic foil, or preferably a braid of metal wires, especially copper wires.

The outer cover is made of a plastic material, such as PVC.

In a preferred form of construction of the connecting cable in accordance with the invention, the ring of wires which are twisted together contains at least as many wires as the total number of coaxial units. The wires can be connected directly to the respective ground contacts when the cable is attached to a connecting plug. There is no need to connect any separate ground connections to the outer conductors of the coaxial units.

It is advantageous if the twisted wires can be visually differentiated from the central conductors (signalling cores) which are likewise to be connected to the plug.

In a further preferred form, the diameter of the twisted wires is chosen so that seven coaxial units which are identical to a circular central coaxial unit are wound together in a single layer around the circle of twisted wires.

The cable in accordance with this preferred form is a compact cable with eight identical coaxial units, which is of particular importance when used in the communication installations or exchanges having binary control. The desired diameter of the twisted wires can be calculated quite easily as a function of the thickness of the coaxial units. A numerical example is given in the description of the figure given at the end of this description.

A very good connecting cable according to the invention is obtained if the layer of twisted wires is bounded by outer conductors of the coaxial units composed of a braid of metal wires.

A combination of twisted wires and outer conductors of this type lead to a cable with both good electrical and mechanical (flexibility) properties. Without the layer of twisted wires, the flexibility of the cable would be considerably reduced on account of the great friction between the braids of the outer conductors. If the outer conductor is a braid of metal wires, it is advisable to provide a laminated outer cover, such as a wound foil of say, polyester, surrounded by an extruded layer of PVC, for example. The polyester foil, for instance a Mylar® foil, presses any metal wires which may be projecting from the braid inwards, so that these cannot damage the outer layer.

BRIEF DESCRIPTION OF THE DRAWING

The invention is further described by way of example by the accompanying drawing, in which the FIGURE shows a cross-section of a connecting cable in accordance with the invention.

DESCRIPTION OF THE PREFERRED EMBODIMENT

In the FIGURE a circular central coaxial unit with the reference number 1 is shown which consists of a central conductor 2 made of silver-plated copper with a diameter of 0.25 mm. Around the central conductor 2, a first dielectric layer 3 of colored polytetrafluoroethylene is applied, followed by a second layer 4 of transparent polyethylene. Layer 4 is surrounded by a braid 5 of copper wires which forms the outer conductor of coaxial unit 1. The diameter of coaxial unit 1 over the outer conductor is 1.6 mm. Around the central coaxial unit 1 a helical layer of copper tinned wires 6 is placed. The diameter of the tinned copper wires 6 is 0.25 mm. The diameter of coaxial unit 1 and the layer of tinned copper wires 6 is 2.1 mm. Around the tinned copper wires 6, seven coaxial units are wound, these being indicated by the reference numbers 7 to 13. The unit 7 to 13 are identical to the central coaxial unit 1, the only difference being that the color of the layer of polytetrafluoroethylene on each unit is different. The central conductor, dielectric layers and outer conductors of the coaxial units 7 to 13 are indicated with the same reference numbers 2 to 5 as are used for the central coaxial unit 1. Over all the coaxial units 7 to 13 an outer cover 14 is placed which consists of a wound polyester foil 15 and an outer layer 16 of polyvinyl chloride. It should be noted that between coaxial units 12 and 13 a strand of steel wire 17 is placed which serves as an identification sign for the sequence of the coaxial units 7 to 13 in the case of automatic handling. The external diameter of the connecting cable according to the FIGURE is 6.0 mm. The impedance is 73±5 ohms at 1 MHz. The capacity of the cable at 800 Hz is 73±5 pF/m. The attenuation at 10 MHz is less than 10 dB per 100 meters.

What is claimed is:

1. An electrical connecting cable comprising:

a central coaxial unit and a plurality of coaxial units wound around the central coaxial unit, each unit comprising a central conductor, a dielectric surrounding the conductor, and an outer conductor surrounding the dielectric; and an outer cable cover of insulating material, wherein the cable further comprises a helically wound layer of electrically conducting wires disposed around the outer conductor of the central coaxial unit, said helically wound layer providing electrical contact between the outer conductors of said central coaxial and said plurality of coaxial units.

2. A cable as claimed in claim 1 wherein said layer of wires contains at least as many wires as the total number of coaxial units.

3. A cable as claimed in claim 1 or claim 2 wherein said outer conductors each consist of a braid of metal wires, and said layer of helically wound wires is bounded by said braids.

4. A cable as claimed in claim 1 or claim 2 wherein said central coaxial unit is circular, said plurality of units consists of seven coaxial units identical to said central coaxial unit, wound together in a single layer, and said wires have a diameter chosen sufficiently large that said layer of wires contacts each of said plurality of units.

5. A cable as claimed in claim 4 wherein said outer conductors each consist of a braid of metal wires, and said layer of helically wound wires is bounded by said braids.

* * * * *